US005453818A

United States Patent [19]

Maehara et al.

[11] Patent Number: 5,453,818

[45] Date of Patent: Sep. 26, 1995

[54] DOCUMENT DETECTION DEVICE AND A COPYING MACHINE PROVIDED WITH THE DOCUMENT DETECTION DEVICE

[75] Inventors: Shigeharu Maehara, Nara; Jun Morimoto, Yamatokoriyama; Toru Morooka, Ikoma, all of Japan

[73] Assignee: Sharp Kabushiki Kaisha, Osaka, Japan

[21] Appl. No.: 265,278

[22] Filed: Jul. 1, 1994

[30] Foreign Application Priority Data

Jul. 9, 1993 [JP] Japan ..... 5-170154

[51] Int. Cl.[6] ..... G03G 21/14

[52] U.S. Cl. ..... 355/206; 355/208; 355/209; 355/311

[58] Field of Search ..... 355/208, 206, 355/209, 311, 75, 203, 204; 250/561, 560

[56] References Cited

U.S. PATENT DOCUMENTS

| | | | |
|---|---|---|---|
| 4,939,553 | 7/1990 | Sato et al. | 355/311 |
| 4,954,846 | 9/1990 | Matsuo | 355/204 X |
| 5,122,833 | 6/1992 | Sato | 355/203 |
| 5,218,408 | 6/1993 | Inada et al. | 355/311 X |
| 5,223,904 | 6/1993 | Umezawa | 355/311 |
| 5,225,688 | 7/1993 | Endo | 250/560 |

FOREIGN PATENT DOCUMENTS

| | | |
|---|---|---|
| 62-91930 | 4/1987 | Japan . |
| 4-242767 | 8/1992 | Japan . |

*Primary Examiner*—R. L. Moses

[57] ABSTRACT

After placing an original document on a document platen of a copying apparatus main body, when a detection switch detects a predetermined angle of θ of a document cover in the course of closing the document cover, a light-emitting device of a distance-measuring sensor is driven. Light released from the light-emitting device is projected onto the original document or the document cover, and the reflected light is received by a light-receiving device. A signal corresponding to the light-receipt point of the light-receiving device is released, and a measurement is made to find the distance from the sensor to the original document or to the document cover based on the signal. A discrimination is made as to the presence or absence of original document based on the measured distance, and copying control suitable for the result of the discrimination is carried out. At this time, if external light or other light is received by the light-receiving device, the output of the light-receiving device exceeds a predetermined range. This state is regarded as no original document is located above the related distance-measuring sensor, and the corresponding process is carried out.

20 Claims, 8 Drawing Sheets

(UNIT mm)

DOCUMENT DETECTION DEVICE AND A COPYING MACHINE PROVIDED WITH THE DOCUMENT DETECTION DEVICE

FIELD OF THE INVENTION

The present invention relates to a document detection device for detecting an original document, and also relates to a copying apparatus, provided with the document detection device, which carries out a copying operation while executing related operations such as, for example, selection of copy sheets in accordance with the size of the original document that is detected by the document detection device.

BACKGROUND OF THE INVENTION

In a conventional copying apparatus, an image of an original document is projected onto a photoreceptor that functions as a recording medium; an electrostatic latent image derived from the projected image is formed thereon; a toner image derived from the developed electrostatic latent image is transferred onto a copy sheet that has been positioned at a set time; the toner image on the copy sheet is fixed thereon through a fixing device; and the copying sheet is ejected out of the copying apparatus.

Thus, the copying apparatus provides copying control suitable for a particular original document by detecting the presence or absence of the original document. In order to execute the copying control, a detection means, which detects the presence or absence of an original document placed on a document platen where an image exposure is made, is provided so that copy start control is executed in accordance with the detection indicating the presence or absence of the original document, or a plurality of means, which detect the presence or absence of the original document as well as detecting the size of the original document, are provided so that automatic selection of copying sheets or automatic setting for copying magnification, etc. is made in accordance with the detected size.

A conventional document detection device has a construction provided with a sensor that allows a light-emitting device (LED), installed for example, below a transparent document platen placed on the top of the copying apparatus, to emit light toward the original document side as well as allowing a light-receiving device to receive the reflected light or the transmitted light, and this construction makes it possible to detect the presence or absence of the original document. Further, a plurality of those sensors capable of detecting the presence or absence of the original document are installed in the document detection device in accordance with the sizes of original documents to be placed thereon; this construction makes it possible to detect the presence or absence of the original document as well as detecting the size of the original document at the same time.

In the case where the presence or absence of the document is detected by receiving the reflected light from the original document, the detection is made while the document cover, which covers the original document from above so as to make it closely pressed onto the surface of the document platen, is closed. In this case, it is necessary to make the detection as to the presence or absence of the document while taking it into consideration the difference between the document cover and the original document. However, the surface of the document cover opposite to the original document has a white color, which is the same color as the original document in most cases; this makes it very difficult to distinguish the original document from the document cover.

For this reason, the reflected light from the original document or the transmitted light through the document platen is received while the document cover is open. This arrangement eliminates the necessity of distinguishing the original document from the document cover, and it becomes possible to readily detect the presence or absence of original document.

However, in the case where the detection is made as to the presence or absence of original document while the document cover is open, it is necessary to take it into consideration not to allow the light-receiving device to receive external light. This consideration tends to limit the installation position or other factors of the copying apparatus. In other words, the copying apparatus should be installed at a location whereto no external light, such as the sun light, is incident. Further, it is also necessary to prevent light of various sources, such as room lighting, from entering the light-receiving device.

Moreover, if an image of half tone, such as a photograph, or a dark image is used as an original document, it becomes more difficult to make a decision as to the present or absence of the document. More specifically, the decision as to the presence or absence of original document is made based on the comparison between a reference value and an output corresponding to the quantity of light received by the light-receiving device; therefore, in the case of the above-mentioned original document which allows only the small quantity of light to be received, it is quite possible to have failure in detection erroneously indicating the absence of original document in spite of the presence of an original document. Consequently, the conventional document detection tends to have a smaller S/N ratio since it is made depending on the quantity of received light, as it is. This gives adverse effects on providing the accurate, stable document detection.

Furthermore, during the detection as to the presence or absence of original document, it is difficult to make a self-diagnosis on a sensor by using its light-emitting and light-receiving devices simultaneously with the detection as to the presence or absence of original document, irrespective of the presence or absence of original document. For this reason, the detection of the document might be operated with disorders in the sensors; this causes wasteful use of copy sheets, that is, erroneous copying operations might be carried out.

SUMMARY OF THE INVENTION

One object of the present invention is to provide document detection device which ensures an accurate detection as to the presence or absence of original document, without any disturbances from external light.

In order to achieve the above object, the document detection device of the present invention is provided with: a first detection means for detecting a state where a document cover, which is attached to a document platen so as to be freely opened and closed, is inclined at a predetermined angle with the document platen, and for releasing a measurement-start signal; a measuring means for measuring a distance to the document on the document platen or to the document cover; a control means for controlling the measuring means so as to allow it to start the distance-measuring operation upon receipt of the measurement-start signal; and a document-existence discrimination means for receiving the distance measured by the measuring means and for detecting the presence or absence of original document by making a judgement that a document is placed when the measured distance is within a predetermined range as well as making a judgement that no document is placed when the measured distance is out of the predetermined range.

In accordance with the above arrangement, after placing an original document on the document platen, when the document cover is inclined at the predetermined angle in the course of being closed, the first detection means detects the angle. In response to this detection signal, the control means drives the measuring means of the document detection device. In other words, the control means drives a light-emitting means installed in the measuring means, and light released from the light-emitting means is received by a light-receiving means after having been reflected from the original document or the document cover. At this time, the light-receiving means receives the reflected light at its position corresponding to the distance, and outputs a signal indicating the position. The distance is measured in accordance with the output signal, and based on the distance, the document-existence discrimination means makes a judgement as to the presence or absence of original document. Further, the document-existence discrimination means judges the measured distance as an effective measurement if the output of the light-receiving means is within the predetermined range, and makes a judgement as to the presence or absence of original document. If the output of the light-receiving means is out of the predetermined range, the document-existence discrimination means makes a judgement that no original document exists, and concludes the operation as having no document being found. This arrangement eliminates adverse effects due to disturbances from external light, and makes it possible to provide an accurate detection as to the presence or absence of original document.

Moreover, if a plurality of the measuring means are installed at positions corresponding to the respective sizes of various copy sheets, not only the detection as to the presence or absence of original document, but also the detection as to the document size, can be made by combining respective detections as to the presence or absence of original document.

Another object of the present invention is to provide a copying apparatus wherein simultaneously as the document detecting process is being performed, a self-diagnosis is made on the measuring means for making a detection as to the presence or absence of original document, and the control of the copying apparatus is executed based on the results of the self-diagnosis, thereby eliminating wasteful use of copy sheets.

In order to achieve the above object, the document detection device of the present invention is provided with: a document platen whereon an original document is placed; a document cover which is attached to the document platen so as to be freely opened and closed; a document detection means for making a detection as to the presence or absence of original document on the document platen; and a copy controlling means for carrying out copy control based on the detection as to the presence or absence of original document made by the document detection means. Further, the document detection means is characterized by: including a first detection means for detecting a state where the document cover, which is attached to the document platen so as to be freely opened and closed, is inclined at a predetermined angle with the document platen, and for releasing a measurement-start signal; a measuring means for measuring a distance to the document on the document platen or to the document cover; a control means for controlling the measuring means so as to allow it to start the distance-measuring operation upon receipt of the measurement-start signal; a document-existence discrimination means for receiving the distance measured by the measuring means and for detecting the presence or absence of an original document by making a judgement that a document has been placed when the measured distance is within a predetermined range as well as making a judgement that no document has been placed when the measured distance is out of the predetermined range; and a copy control means for carrying out a copying operation in the presence of an original document in response to the document-existence discrimination means and for inhibiting a copying operation in the absence of an original document.

In accordance with the above arrangement, the control of the copying operation is executed based on the document detection. For example, if an original document is detected, the copying operation is started based on a starting instruction, and if no original document is detected, the copying operation is inhibited based on the starting instruction.

Moreover, if a plurality of the measuring means are installed at positions corresponding to the respective sizes of various copy sheets, not only the detection as to the presence or absence of original document, but also the detection as to the document size, can be made by combining respective detections as to the presence or absence of original document. This makes it possible to provide a copying control suitable for the particular size of an original document.

In addition to the above arrangement, the copying apparatus of the present invention is characterized by further including: a second detection means for detecting the closed state of the document cover and releasing a second measurement-start signal; a comparison means for comparing a distance measured by the measuring means in accordance with the second measurement-start signal with a reference distance; a decision means for making a decision that the measuring means is normally operable when the measured distance is within a predetermined range, and for making a decision that the measuring means is inoperable when the measured distance is out of the predetermined range, as the result of the comparison; and copy control means for carrying out copying control based on the output of the document-existence discrimination means in the case of the decision that the measuring means is normally operable, and for manually carrying out copying control irrespective of the output of the document-existence discrimination means in the case of the decision that the measuring means is inoperable.

In accordance with the above arrangement, if the second detection means, which detects the closed state of the document cover, makes a detection as such, the measuring means is driven so as to start an operation for measuring a reference distance from the document-bearing surface in the closed state of the document cover. This distance measured is compared with a predetermined reference distance, and if it is within the reference distance, a self-diagnosis is made that the measuring means is normally operated. In contrast, if it is out of the reference distance, a self-diagnosis is made that the distance-measurement of the measuring means is incorrect. Therefore, the copying control is carried out based on an accurate judgement as to the presence or absence of original document that is made by the measuring means in the normal state. Moreover, if the result of the self-diagnosis shows the inoperable state, the manual copying control is readily carried out, thereby preventing wasteful use of copy sheets due to failure in the document detection.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a cross-sectional view showing a main part of one example of a copying apparatus that is provided with a document detection device of the present invention.

FIG. 2 is a block diagram showing a construction of a control circuit that is installed in the copying apparatus of the present invention.

FIG. 3 is a top view showing one example of a layout of sensors that constitute the document detection device of the present invention.

FIG. 4 is a cross-sectional view showing a structure of a PSD sensor that is one example of a distance-measuring sensor of the present invention.

FIG. 5 is an equivalent circuit diagram of the PSD sensor of FIG. 4.

FIG. 6 is an explanatory drawing showing a principle of distance measurement.

FIG. 7 is a controlling flow chart that shows one example of the document detection of the present invention.

FIG. 8 is a controlling flow chart that shows one example of a self-diagnosis in relation to the document detection sensor of the present invention.

FIG. 9 is a block diagram showing a circuit construction of another embodiment of the present invention.

DESCRIPTION OF THE EMBODIMENTS

Referring to FIGS. 1 through 9, the following description will discuss one embodiment of the present invention.

Figure 1:
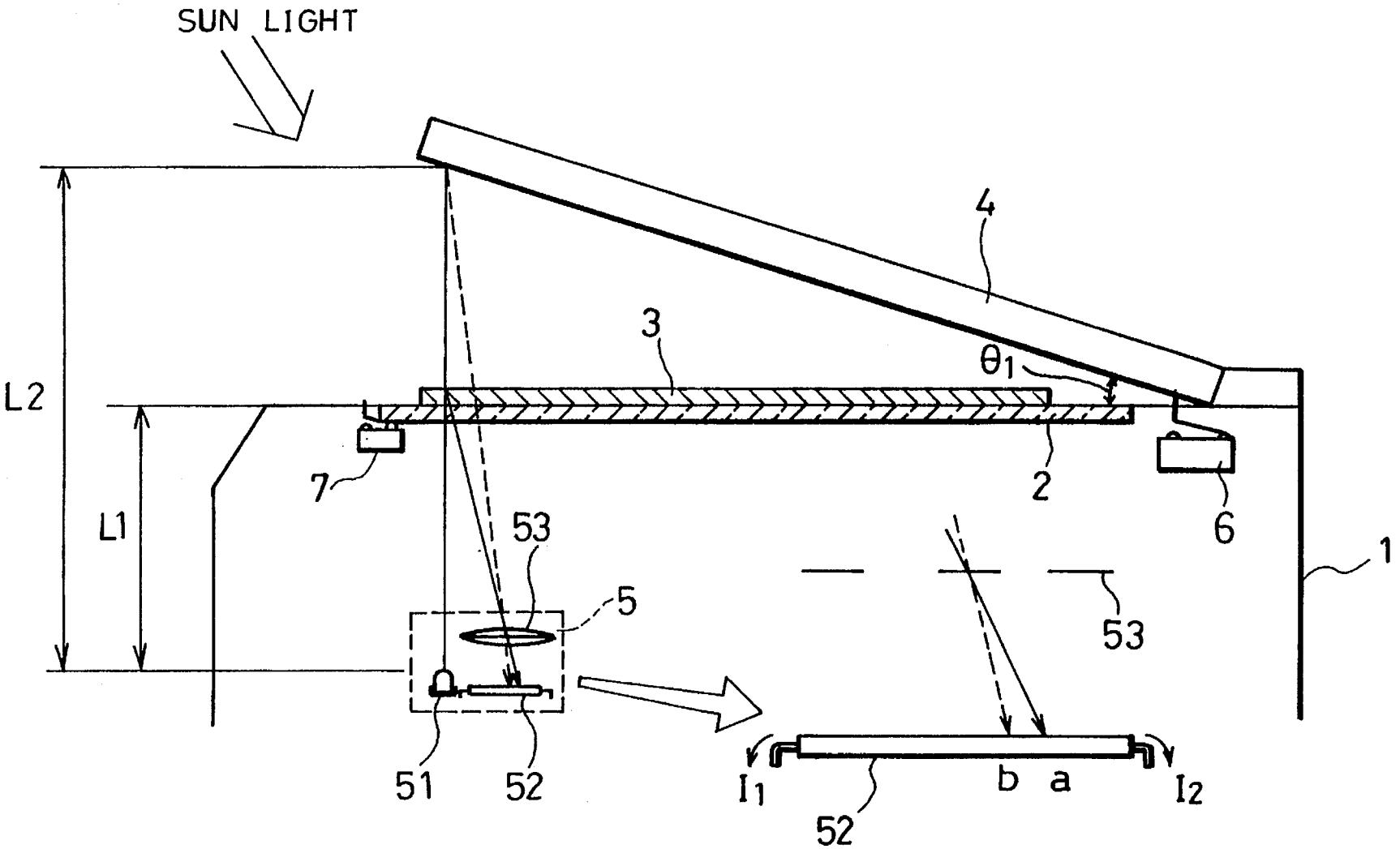
FIGS. 1 through 9 show one embodiment of the present invention.
Figure 2:
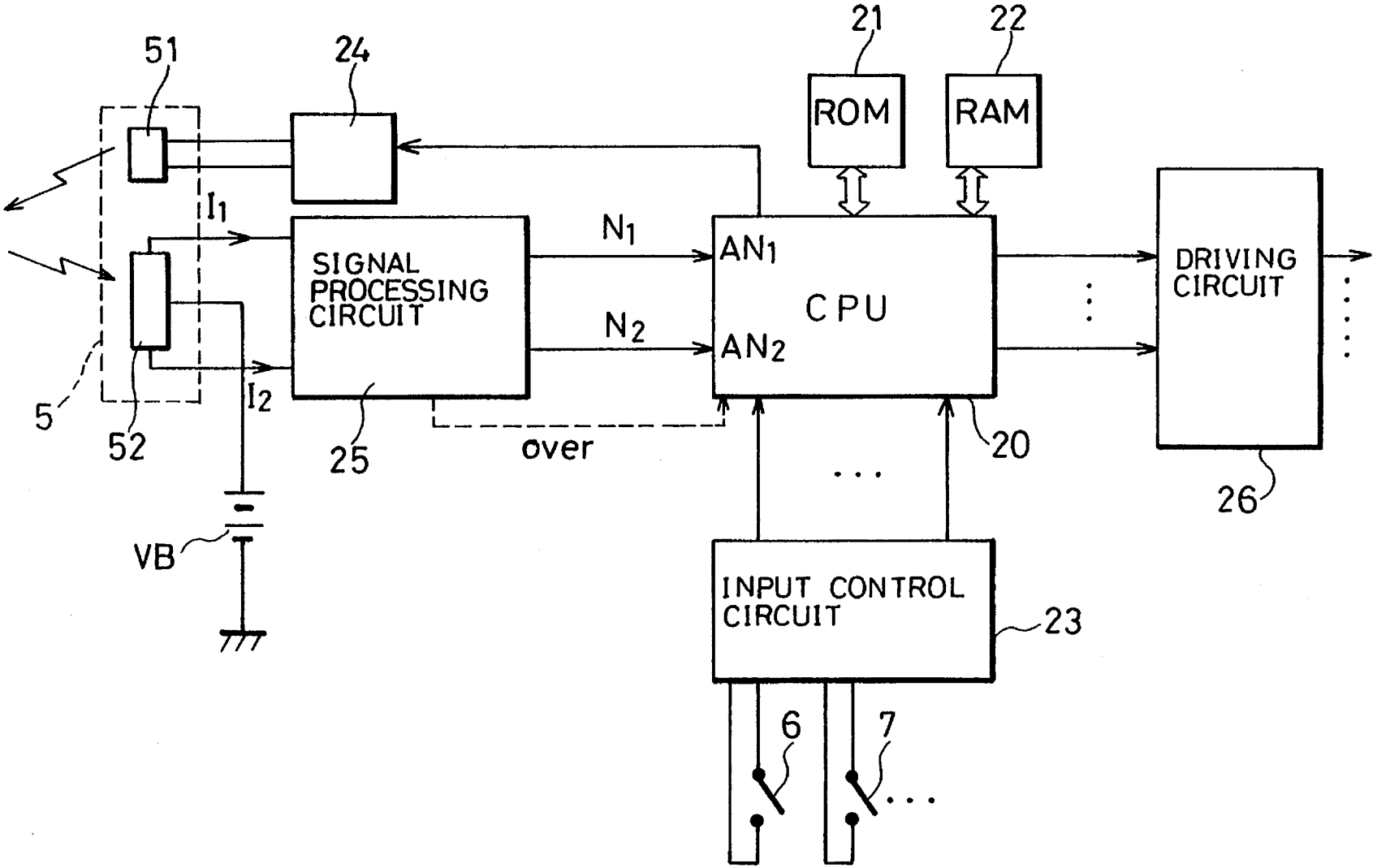

FIG. 1 is a cross-sectional view showing a copying apparatus that is provided with a document detection device of the present invention. FIG. 2 is a block diagram showing a controlling circuit of the copying apparatus that includes a document-detection controlling circuit of the document detection device.

In FIG. 1, a document platen 2, made of a transparent glass plate, is installed on the top of a copying apparatus main body 1. An original document 3 is placed on the document platen 2 with its leading edge aligned to a reference edge, not shown. A document cover 4, which covers the original document 3 from above so as to make it closely pressed onto the surface of the document platen 2, is rotatably secured to one side of the copying apparatus main body 1 in the vicinity of one edge of the document platen 2 so as to be freely opened and closed. The surface of the document cover 4 opposite to the document platen 2 normally has a white color.

The original document 3, which is placed on the document platen 2 as described above, has its image exposed onto a drum-shaped photoreceptor through an optical system that is constituted of an exposure-use light source, an image-converging lens, reflection mirrors, and other members, not shown, and an electrostatic latent image is formed on the photoreceptor drum. On the periphery of the photoreceptor drum, various devices for forming an image are disposed. For example, a main charger, a developing section, a transferring device, a cleaning section, a static eliminating device, etc. are disposed, and the exposure by the use of the optical system is conducted between the main charger and the developing section. Accordingly, the electrostatic latent image, which is derived from the exposed document image and is formed on the photoreceptor drum, is developed by toner, and the toner image thus developed is transferred by the transferring device onto a copy sheet that is properly fed thereto. Thereafter, the copy sheet is separated from the surface of the photoreceptor drum, and conveyed to the fixing device, and then ejected out of the copying apparatus. In the case of forming another image onto the copy sheet bearing the image, that is, for example, in the case of forming another image onto the surface opposite to the image-bearing surface of the copy sheet, the copy sheet is temporarily conveyed to an intermediate tray without being ejected, and the copy sheet is again transported to the transferring position from the intermediate tray.

In this arrangement, the following description will discuss a construction of the document detection device of the present invention for detecting whether or not an original document is placed on the document platen 2. The document detection device of the present invention has a distance-measuring sensor 5 that is disposed at a position below the document platen 2, from which it gives no effects on the document-image scanning that is made by the optical system. The distance-measuring sensor 5 is constituted by a light-emitting device (infrared LED) 51 and a light-receiving device 52. Light released from the light-emitting device 51 is projected onto the surface of the original document 3 or the surface of the document cover 4, and by allowing the light-receiving device 52 to receive the reflected light through a projection lens 53, a detection is made as to the presence or absence of original document. This detection as to the presence or absence of original document will be described later in detail, together with the construction of the sensor 5.

Moreover, the document detection device is provided with a mechanical detection switch 6, such as a microswitch, which functions as a detection means for detecting a state in which the document cover 4 makes an open angle of θ in order to make the distance-measuring sensor 5 start its measuring operation. Therefore, the document cover 4 is opened, an original document is placed, and in the course of closing the document cover 4, the detection switch 6 detects the state in which the document cover makes a tilt angle of θ. The detection switch b is installed in the proximity of the axis portion that allows the document cover 4 to be freely opened and closed. In response to the detecting operation of the detection switch 6, a measuring operation is started by the distance-measuring sensor 5. In this method, light from the light-emitting device 51 is projected onto an original document 3, or onto the document platen 4 in the state where no original document is placed, and by allowing the light-receiving device 52 to receive the reflected light, the distance to the original document 3, or to the document cover 4, is measured.

Here, the detection as to the presence or absence of original document by the use of the distance-measuring sensor 5, that is, the discrimination as to the presence or absence of original document, is carried out by examining the relationship between the distance L1 from the original document 3 to the distance-measuring sensor 5 and the distance L2 from the document cover 4 to the distance-measuring sensor 5, especially, by examining the difference thereof. For this reason, the document detection device is provided with a document discrimination means for making a discrimination as to the presence or absence of original document based on a measured distance that is obtained by the distance-measuring sensor 5. In particular, the document discrimination means makes the discrimination as to the presence or absence of original document based on which distance the measured distance corresponds to, by the use of the relationship, L1<L2, that holds between L1 and L2. In this case, the distance-measuring sensor 5 measures the distance in the state where the opened document cover 4 makes the angle θ, and makes the discrimination as to whether the measured distance is L1 or L2; therefore, since the difference between L1 and L2 is substantially large, it becomes easier to make the discrimination and it is possible to provide an accurate detection as to the presence or absence of original document.

Moreover, in the present invention, the copying control of the copying apparatus main body is executed based on the detection as to the presence or absence of original document that is made by the document detection device including the distance-measuring sensor 5. More specifically, in the state where the presence of an original document is detected, a copying operation is allowed to start upon receipt of a starting instruction through the operation of a copy-start switch; while in the state where no original document is present, the start of a copying operation is inhibited upon receipt of the starting instruction through the operation of the copy-start switch. Thus, this arrangement eliminates an erroneous copying operation that might be carried out without an original document on the document platen 2.

Figure 3:
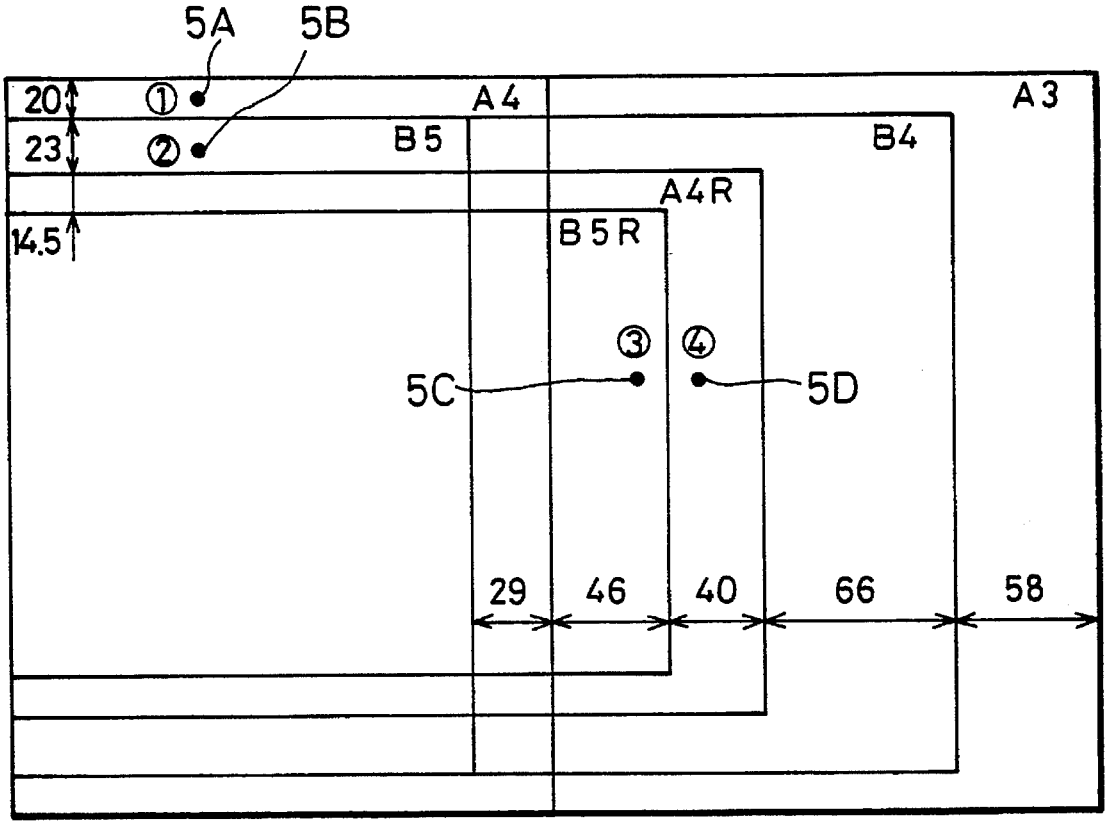

Furthermore, the document detection device also detects the size of an original document if a plurality of distance-measuring sensors 5 are installed. As illustrated in FIG. 3, by disposing distance-measuring sensors 5A through 5D that correspond to the respective sizes of original documents 3 to be placed, it is possible to detect at least six kinds of document sizes. The following Table 1 shows the document sizes in this case, and the document discrimination means makes detections as to the presence or absence of original document in accordance with distance-measurements made by the respective distance-measuring sensors 5A through 5D, and the size of the original document in question is easily detected based on the combination of detections as to the presence or absence of original document that are made by the respective sensors 5A through 5D.

TABLE 1

| Document Sizes | Sensor No. 5A | 5B | 5C | 5D |
|---|---|---|---|---|
| B5 | x | o | x | x |
| A4 | o | o | x | x |
| B5R | x | x | o | x |
| A4R | x | x | o | o |
| B4 | x | o | o | o |
| A3 | o | o | o | o |

(o: Document "Present"/x: Document "Absent")

FIG. 2 is a block diagram showing a control circuit installed in the copying apparatus that includes the control circuit of the document detection apparatus; the following description will discuss the control system by reference to this drawing.

As illustrated in FIG. 2, the control system is provided with a microcomputer and a master CPU 20 that functions as a control means. The master CPU 20 receives signals from various keys and sensors through an input control circuit in accordance with a program that is preliminarily stored in the ROM 21, and controls the copying operation. The master CPU 20 is also provided with means that discriminates the presence or absence of an original document as well as finding the distance in accordance with the output signal from the distance-measuring sensor 5. In other words, the master CPU 20 includes a document-existence discrimination means in the document detection device, and provides its control. The CPU 20 allows the RAM 22 to store information that is required for controlling the copying operation as well as detecting the presence or absence of original document, that is, the essential function of the present invention, and provides control in accordance with the contents of the storage.

For example, the CPU 20 supplies a signal for driving the light-emitting device 51 of the distance-measuring sensor 5 to the driver 24 by inputting through the input control circuit 23 the signal from the detection switch 6 that detects the open state of the document cover 4, and inputs the signal obtained from the light-receiving device 52 through the signal processing circuit 25 so as to allow the RAM 22 to store the data. Further, the CPU 20 calculates the distance from the sensor 5 to the measured object, that is, the original document 3 or the document cover 4, based on the data stored in the RAM 22, and finds the result of the measurement. In accordance with the results of the measurement, discriminations are made as to the presence or absence of original document respectively by the distance-measuring sensors 5A through 5D, and the size of the original document in question is detected through combinations of the discriminations as to the presence or absence of original document, as is explained in Table 1.

Thus, the CPU 20 controls devices for executing various image-forming processes through a driving circuit 26. In particular, the CPU 20 automatically selects the size of copy sheet that is suitable for the document size in question, and drives a paper-feed means so as to supply the corresponding copy sheet. Further, the CPU 20 automatically selects the copy magnification based on a copy-sheet size that has been manually selected as well as on the detected size of the original document, and controls the optical system so as to carry out the copying operation suitable for the magnification as well as controlling the scanning speed at which the original document is optically scanned. Moreover, the CPU 20 controls the start and stop of power supply to copying lamps in the optical system, and adjusts the level of effective voltage to be applied to the copying lamps. Furthermore, the CPU 20 carries out control operations on demand, including control operations for power to be supplied to the main charger, the developing device, the transferring device, the cleaning device, and the static eliminating device, through the driving circuit 26.

The following description will discuss the operation of the copying apparatus that is provided with the document detection device having the above-mentioned arrangement.

An original document 3 is placed on a predetermined position on the document platen 2 with its document cover 4 opened. When the document cover 4 is inclined at the predetermined angle θ in the course of being closed, this state is detected by the detection switch 6. When the CPU 20 receives the detection signal from the detection switch 6 through the input control circuit 23, the CPU 20 allows the distance-measuring sensor 5 to start measuring the distance by the use of the driver 24.

More specifically, the light-emitting device 51 of the distance-measuring sensor 5 is driven by the driver 24; the emitted light is reflected from the original document 3 or the document cover 4; and the reflected light is received by the light-receiving device 52. At this time, the light-receiving device 52 receives the reflected light at different positions, that is, different light-receiving points, that correspond to the distances from the measured objects as shown in FIG. 1, and a signal corresponding to the position in question (current I1 or I2) is released. This signal, which is formed depending on the respective light-receipt conditions, is voltage converted in the signal processing circuit 25, and the CPU 20 inputs the resulting signal to the RAM 22 through its analog input port, thereby allowing the digital data corresponding to this voltage value to be stored at a predetermined area in the RAM 22. The CPU 20 calculates the distance between the distance-measuring sensor 5 and the original document 3 or the distance between the distance-measuring sensor 5 and the document cover 4 based on the data storage. The detection is made as to the presence or absence of original document by the use of the measured distance, and the size of the original document in question is discriminated based on the combination of detections as to the presence or absence of original document that are made by the respective sensors 5A through 5D.

The document detection device is operated as explained above, and the copying operation of the copying apparatus is controlled in accordance with the document detections made by the document detection device. For example, the automatic selection of the size of copy sheets is made in accordance with the size of the original document, or the automatic setting of the copy magnification is made in accordance with the selected size of copy sheets and the detected size of the original document. Thus, the copying operation is started in response to the starting instruction entered through the operation of the copy start switch in order to obtain desired copies.

In this case, the CPU 20 not only functions as the copy control means for controlling the copying apparatus, but also functions as the means for measuring distances and discriminating the presence or absence of original document in the distance-measuring sensor 5 related to the document detection device. In a separated manner from the CPU 20 that constitutes the copy control means for executing the copying control, another control means may be separately employed in order to control the start of the distance measurements, discriminate the presence or absence of original document based on the measured distances, and discriminate the size of the original document based on the respective states of the presence or absence of the original document. In this arrangement, in addition to the CPU 20 that functions as a master CPU for controlling the copying operation, a slave CPU is installed for controlling the document detection device in response to the instruction of the master CPU. The slave CPU operates the driving control of the distance-measuring sensor 5 in response to the instruction from the CPU 20 based on the detection signal of the detection switch 6, executes distance measurements (calculations) by the use of the input signal from the signal processing circuit 25, and discriminates the presence or absence of original document based on the distance measurements as well as discriminating the size of the original document. The resulting data is sent to the master CPU 20, if necessary, and the master CPU 20 operates the copying control that is suitable for the original document in question.

The following description will discuss one example of the distance-measuring sensor 5 of the present invention in detail. For example, a "distance-measuring sensor with 8-bit accuracy", which is described on pages 24–27 in "Sensor Technology", October Issue, Vol. 12, No. 11, 1992, published in Japan, is employed as the distance-measuring sensor 5. This distance-measuring sensor is called PSD (Position Sensitive Detector), which executes distance-measurements by projecting light to an object to be measured from a light-emitting device and detecting an incident position in the sensor with respect to the reflected light from the object.

Figure 4:
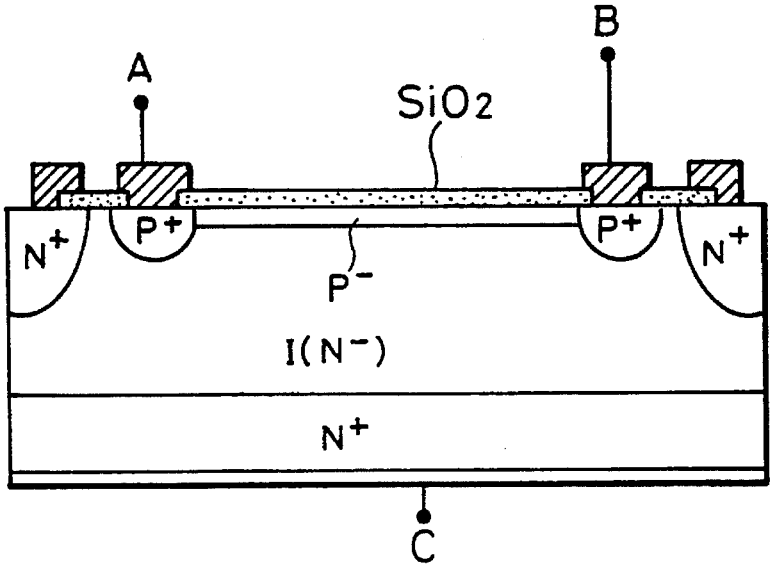

A brief explanation will be given on the distance-measuring sensor hereinbelow: This sensor, which is a kind of PIN-type photodiode, is constituted by a p–layer provided on the surface of a silicon chip, a $n^+$ layer provided on the back of the chip, and an i layer located in between, as illustrated in FIG. 4, and electrodes A, B, and C are respectively attached to the surface and the back of those layers in a manner shown in the drawing. An equivalent circuit of a PSD sensor having the construction shown in FIG. 4 is indicated by FIG. 5.

Figure 5:
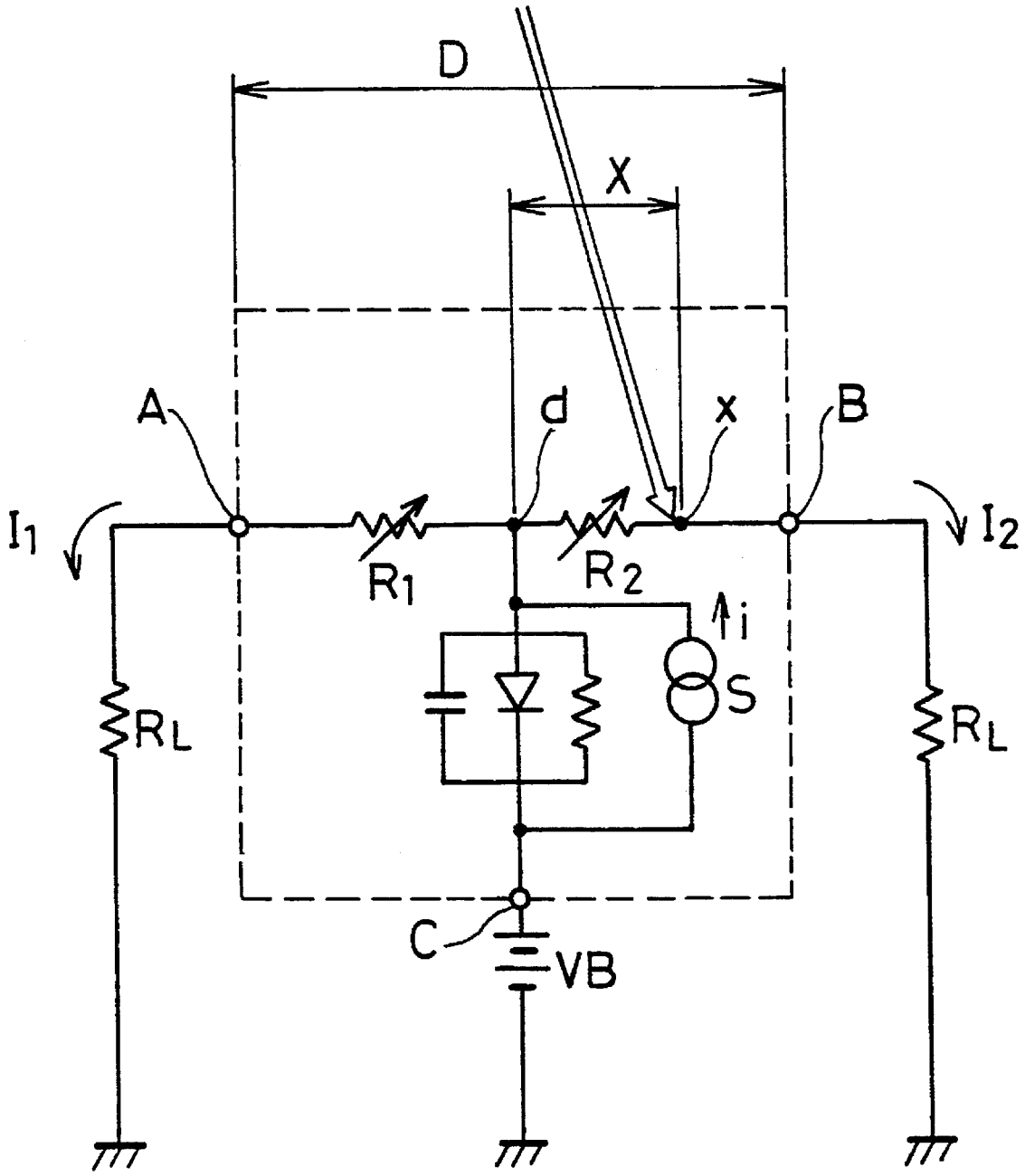

In FIG. 5, when a bias voltage VB is supplied to the electrode C, the resistances R1 and R2 vary depending on positions (spot positions) of light that is incident to the surface. For example, if the light is incident to the middle point (point d) between the electrodes A and B, R1 : R2=1:1 holds. If the incident light is biased to either the electrode A or B, the ratio of R1 : R2 varies in proportion to the incident position. Here, supposing that the light is incident to a position that is biased toward the electrode B side by X with respect to the middle point d, and that the length of the light-receiving face of the sensor (the distance between the electrodes A and B) is designated by D, the following equations hold, where R1+R2=R0:

$$R1=R0/2(1+2X/D)$$

$$R2=R0/2(1-2X/D)$$

Therefore, by utilizing the variations of the resistances that are caused by the incident positions (spot positions) of light on the light-receiving face of the PSD sensor, variations of currents I1 and I2, which are respectively taken from the electrodes A and B as shown in FIG. 5, are found. At this time, the ratio of these currents I1/I2 is directly proportional to, for example, the distance from the electrode B (inversely proportional to the distance from the electrode A). In this case, although the absolute values (outputs) of the currents I1 and I2 vary with the quantity of light that is incident to the PSD sensor, the incident position of light is not affected by the slight variation of the quantity of light because it is directly proportional to the ratio of the currents I1/I2.

Therefore, by utilizing this ratio of the currents I1/I2, it is possible to identify the position of the incident light on the light-receiving face in the PSD sensor, thereby ensuring a more accurate distance detection. In other words, the distance is measured not by using the current outputs themselves that depend on the quantity of light, but by using the ratio of the currents; therefore, having a greater ratio of the currents means that the incident light is closer to the electrode A side in the PSD sensor, and having a smaller ratio of the currents means that the incident light is closer to the electrode B side therein. Thus, the ratio of the currents varies in proportion to the distance.

Figure 6:
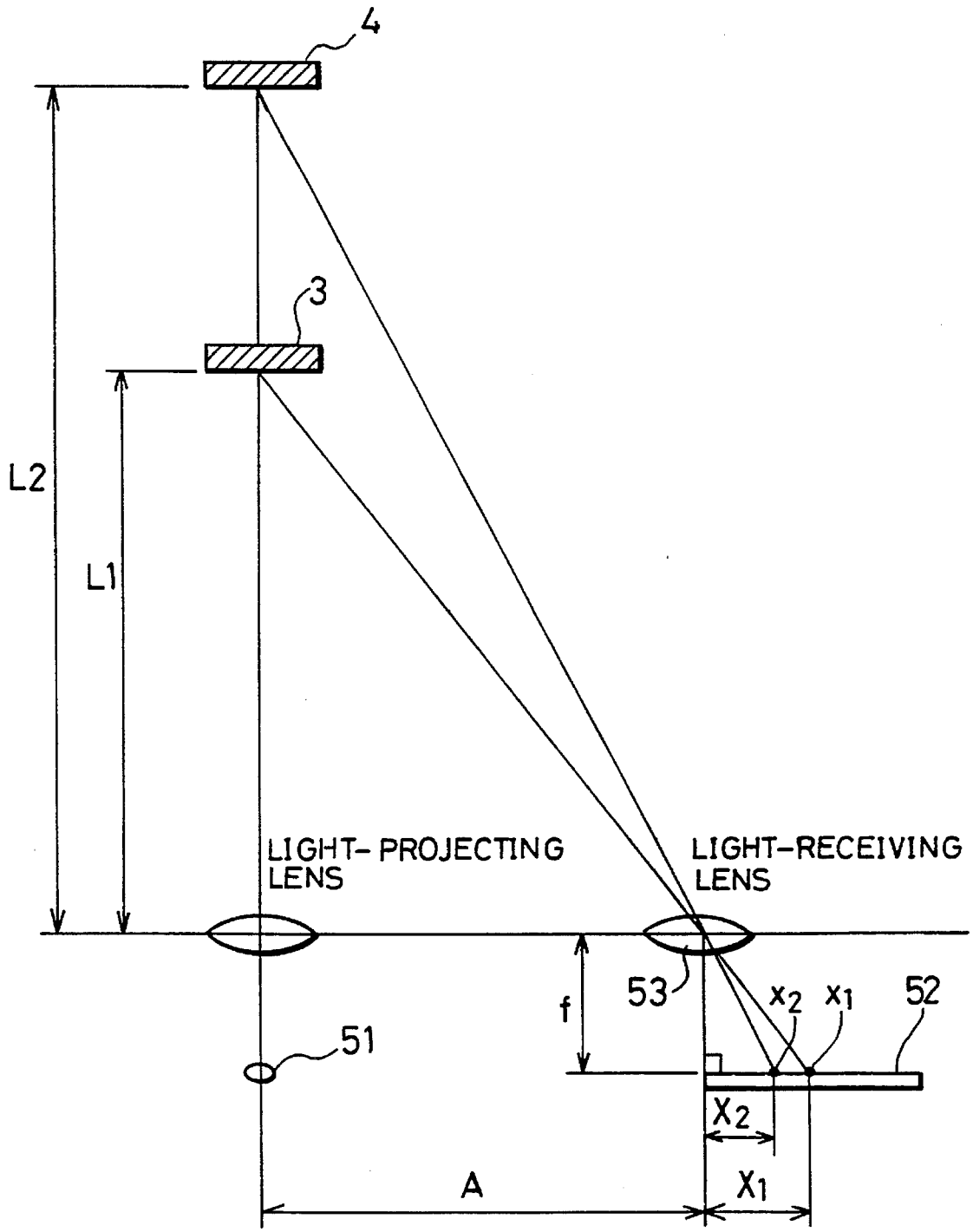

For example, as illustrated in FIG. 6, light released from the light-emitting device (infrared LED) 51 in the distance-measuring sensor 5 of the present invention is projected onto an object to be measured (the original document 3 or the document cover 4), and the reflected light is received by the light-receiving device 52 in the PSD sensor consisting of the distance-measuring sensor 5 through the light-receiving lens 53. At this time, in the relationship shown in FIG. 6, the distance X (X1 or X2) from the light-receipt point (spot) to the central point of the light-receiving lens is found through the following equation:

$$X=A\cdot f/L1$$

where A: the distance between the centers of the light-projecting lens (the position of the light-emitting device 51) and the light-receiving lens; L1: the distance from the light-projecting lens to the object to be measured, namely, the distance to the original document 3 in the present invention; and f: the focal distance of the light-receiving lens. Thus, the farther the distance from the object to be measured, the smaller the distance from the position of the light-receipt spot to the center of the light-receiving lens in the light-receiving face of the PSD sensor. In other words, if the object to be measured is the original document 3, the distance from the position of the light-receipt spot to the center of the light-receiving lens is represented by X1; while if the object to be measured is the document cover 4, the distance from the position of the light-receipt spot to the center of the light-receiving lens is represented by X2 (X1>X2). Conversely, the greater the distance from the position of the light-receipt spot to the center of the light-receiving lens, the nearer the distance from the object to be measured. This makes it possible to measure the distance L1 or L2.

Since a given point x on the light-receiving face in the PSD sensor is identified by using the ratio of the currents I1/I2 that is obtained from the electrodes A and B as described earlier, it is possible to easily measure the distance L from the light-emitting device 51 to the object to be measured, that is, the distance to the distance-measuring sensor 5 of the light-receiving device 52.

As illustrated in FIG. 2, in the present invention, the currents I1 and I2, which are obtained from the PSD sensor that functions as the distance-measuring sensor 5, are converted into voltages V1 and V2 by the signal processing circuit 25, and inputted to the CPU 20 through the analog-port input section thereof. Here, the CPU 20 includes the discrimination means and other means for use in the document detection of the document detection device. The signal processing circuit 25 conducts the converting processes so as to produce voltage values having the equivalent values or the same ratio as the inputted currents I1 and I2. The CPU 20 stores these voltage values in the RAM 22, if necessary, and based on the stored data, calculates the value corresponding to the ratio I1/I2, finds the spot position (x) on the distance-measuring sensor 5, and calculates the distance L to the object to be measured in accordance with the above-mentioned equation for finding X.

Figure 7:
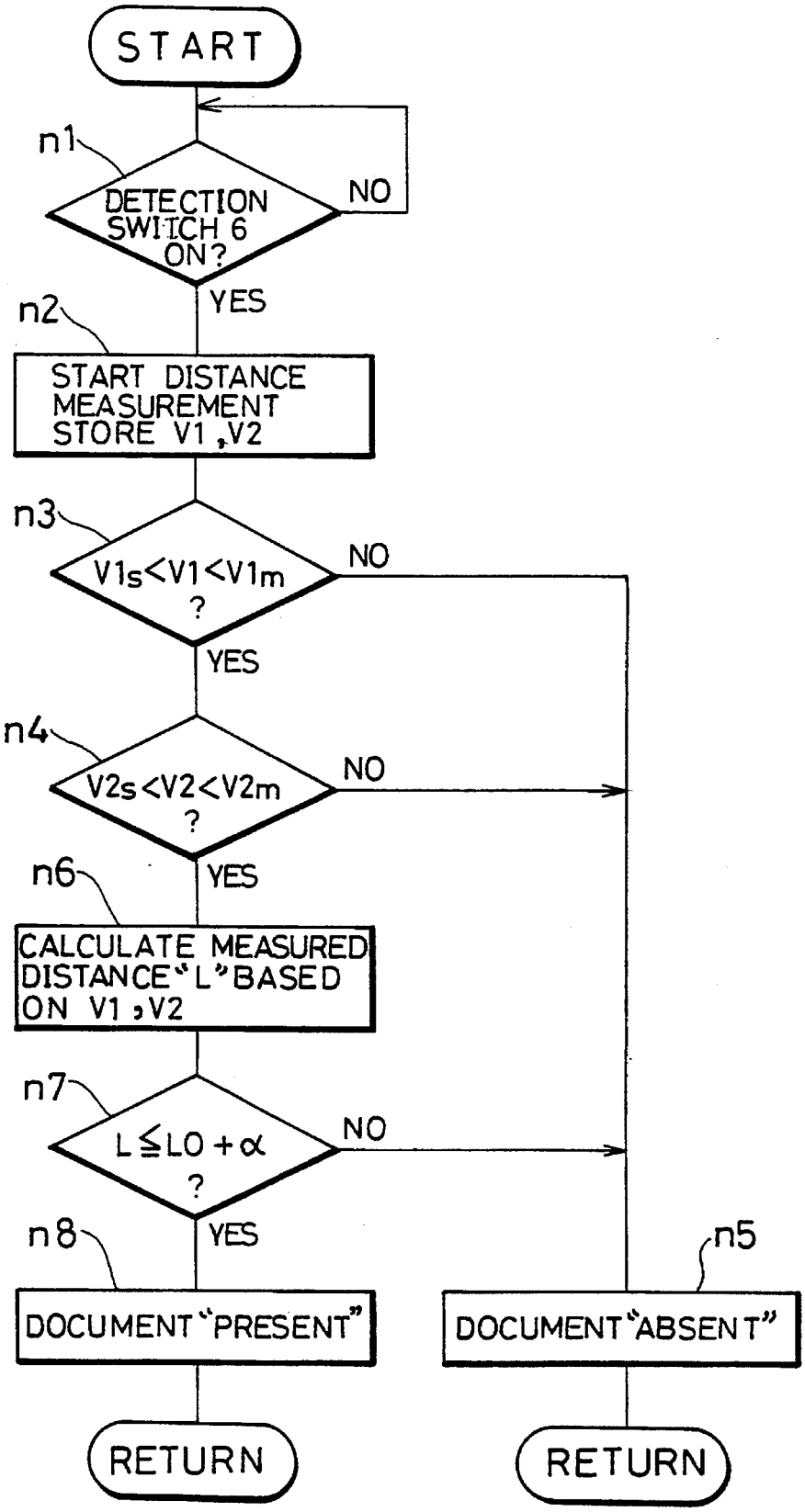
Figure 8:
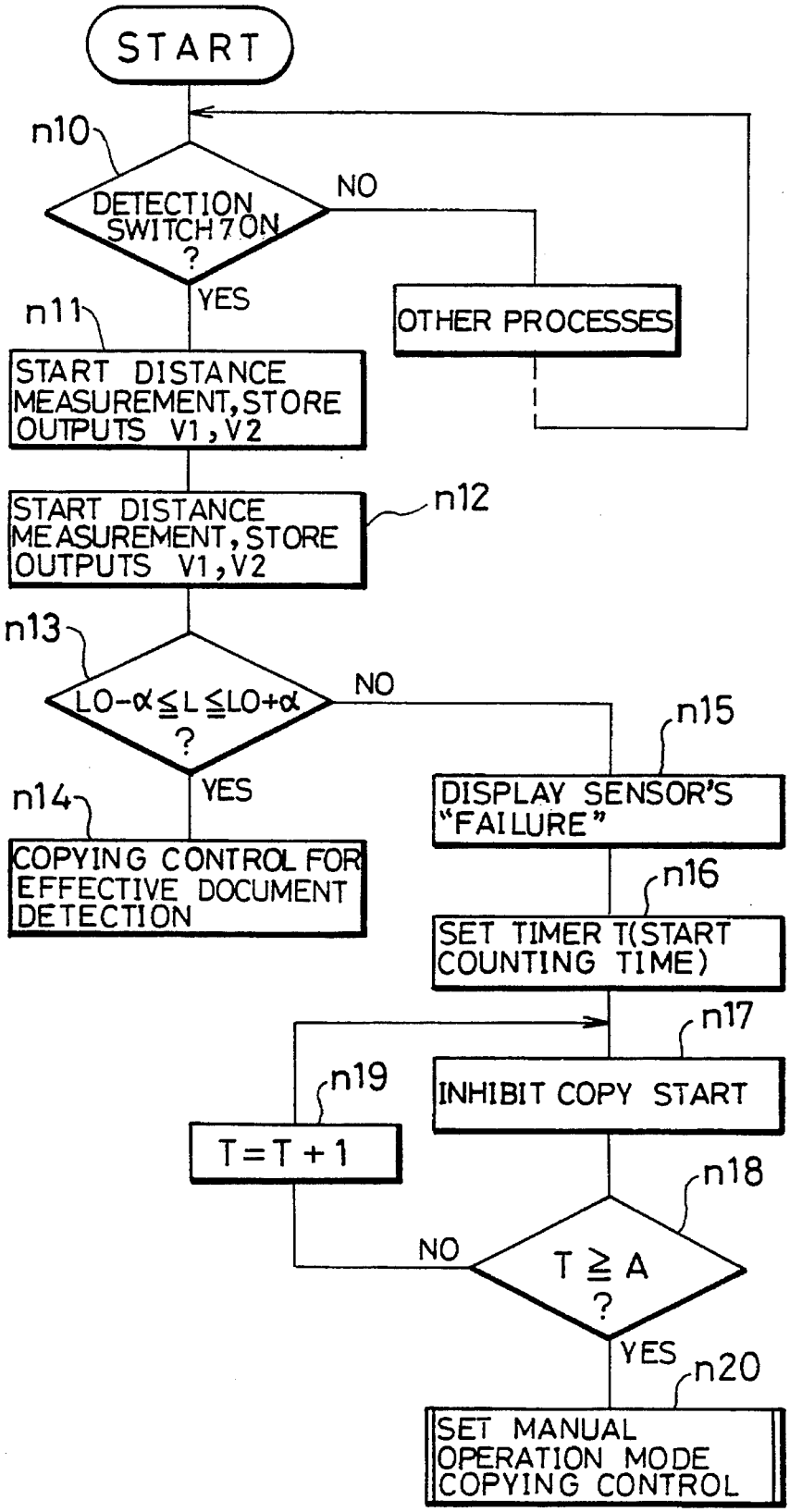

Referring to FIGS. 7 and 8, the following description will discuss the control operation of the detection as to the presence or absence of document of the document detection device as well as the copy control operation of a copying apparatus that is provided with the document detection device.

FIG. 7 is a flow chart showing control for discriminating the presence or absence of original document by measuring the distance to the original document or to the document cover after making a discrimination as to whether the light in question is derived from the original document or from external light.

An original document 3 is placed on the document platen 2 with its image-bearing face down while the document cover 4 is open. When the document cover 4 is inclined to make a tilt angle of θ in the course of being closed, the detection switch 6 operates (n1), thereby driving the distance-measuring sensor 5 for measuring distance.

In other words, in the case of detecting the presence or absence of original document on the document platen 2, the distance-measuring sensor 5, which is located in relation to a reference position at which the original document is placed, is driven. In the case of detecting the presence or absence of original document as well as detecting the size of the original document, the distance-measuring sensors 5A through 5D, which are disposed as shown in FIG. 3, are respectively driven. At this time, if problems, such as crosstalk, are raised with respect to the sensors 5A through 5D, they may be driven for scanning in a time-divided manner.

After the distance-measuring sensor 5 has been driven in order to detect the placed state of original document as described above, the signal processing circuit 25, upon receiving the output from the light-receiving device 52, converts the currents derived from the output signal into voltages. The CPU 20 receives the voltages V1 and V2 through the analog-port input section, and after converting them into digital data, stores them (n2) in a predetermined area in the RAM 22.

Next, at steps n3 and n4, the CPU 20 compares the data V1 and V2 related to the distance measurement with predetermined output values of the distance-measuring sensor 5 to find the relationship therebetween. Here, it might be possible that extremely strong external light, such as sun light, is directly incident to the distance-measuring sensor 5 in the state where no original document is present on the document platen 2. Further, if the output from the distance-measuring sensor 5 is extremely small, it might be possible that the reflected light from the original document 3 or the document cover 4 derived from the light emitted from the light-emitting device 51 is not incident to the light-receiving device 52. For example, in the case where the document cover 4 has become dirty after long-time use, the reflected light tends to fail to be incident to the light-receiving device 52, thereby making its output extremely small.

Therefore, at n3 and n4, the CPU 20 makes the comparisons in order to find whether or not the data V1 and V2 inputted from the distance-measuring sensor 5 are maintained at levels within a predetermined range. For this reason, the maximum value (V1m) and minimum value (V1s) of the output V1 as well as the maximum value (V2m) and minimum value (V2s) of the output V2, both of which are produced when the light from the light-emitting device 51 is received by the light-receiving device 52 after having been reflected by the original document 3 or the document cover 4, are preliminarily determined through experiments or other methods, and these values are preliminarily stored in the RAM 22, the ROM 21, or other device. As to the maximum values and the minimum values, it is preferable to determine those values by estimating slight errors in advance. In particular, in the case where external light, such as sun light, might be directly incident, it is preferable to determine those values by using the estimated values in the order of several times. Here, the maximum values and the minimum values of the voltages V1 and V2, which correspond to the currents I1 and I2 that are obtained from the distance-measuring sensor 5 through the signal processing circuit 25, become virtually the same values respectively.

Therefore, after the light-emitting device 51 has been driven, comparisons are made at n3 and n4 to find whether or not the outputs from the distance-measuring sensor 5 are within the predetermined range, that is, to find whether or not they are derived from the light-emitting device 51. If they are not within the predetermined range, a decision is made that the outputs of the distance-measuring sensor 5 are unreasonable, and the corresponding process is carried out. In this case, at n5, the same process that is executed when no original document 3 is present (absence of original document) is carried out. The situation where the outputs of the distance-measuring sensor 5 are not within the predetermined range shows that external light is directly incident to the light-receiving device 52 of the sensor 5, or that the light from the light-emitting device 51 is not incident to the light-receiving device 52 because it is not reflected by the document cover 4 in a proper manner in the case of absence of original document. In particular, if the light is not reflected by the document cover 4, the process that is taken upon absence of original document is carried out unconditionally since it is most possible that the document cover 4 has partially become dirty due to long-time use.

In contrast, when the outputs from the distance-measuring sensor 5 are within the predetermined range, the CPU 20 finds the distance L up to the original document 3, placed as the object to be measured, or up to the document cover 4, based on the data (voltage) V1/V2 corresponding to I1/I2 released from the distance-measuring sensor 5 at n6.

After the distance L has been found, the CPU 20 makes a discrimination, for example, as to whether or not the measured distance L is not more than a reference distance LO (n7). In other words, the reference distance LO represents the distance from the distance-measuring sensor 5 to the document-bearing surface, which is a constant value. For this reason, if, upon comparing the measured distance L with the reference distance LO, it is not more than, or more preferably, equal to the reference distance LO, the process of n8 is carried out based on the decision that the original document 3 is present. In contrast, if it is more the reference distance LO, that is, if the measurement represents the distance L2 up to the document cover 4, the above-mentioned process of n5 is carried out based on the decision that no original document 3 is present, which is made according to the longer distance than the reference distance LO.

Here, as to the reference distance LO, taking into consideration warp of the original document or other phenomena, it is preferable to set a value obtained by adding the value $\alpha$ representing the corresponding distance. For this reason, if the measured distance L is within the range, "$LO \leqq L \leqq LO+\alpha$", at n7, the original document is present. However, if it is out of the range, that is, if $LO+\alpha<L$ is satisfied, a decision is of course made that no original document is present, thereby performing the corresponding process. In this case, if the measurement represents the distance L2 up to the document cover 4, $LO+\alpha<L$ is of course satisfied, and the corresponding process to absence of original document is carried out.

As described above, by measuring the distance up to the original document, or up to the document cover, the difference is obtained sufficiently; this ensures an accurate detection as to the existence of original document. Even if the output currents from the sensor 5 vary slightly, the ratio of the currents hardly varies although the absolute values of I1 and I2 themselves vary. This makes it possible to perform stable distance measurements, thereby ensuring an accurate detection as to the presence or absence of original document.

Additionally, in the case where the outputs from the distance-measuring sensor 5 that are related to the distance measurements are not within the predetermined range at n3 and n4, another arrangement may be made so that the process corresponding to absence of original document is immediately executed without performing the distance measurements, that is, without releasing the distance data that are obtained through calculations based on the measured data; this arrangement further improves reliability. In other words, if the distance measurements (more specifically, calculations) are made by using the outputs in question, it is difficult to obtain an accurate distance, thereby giving rise to the possibility of erroneous operation.

Figure 9:
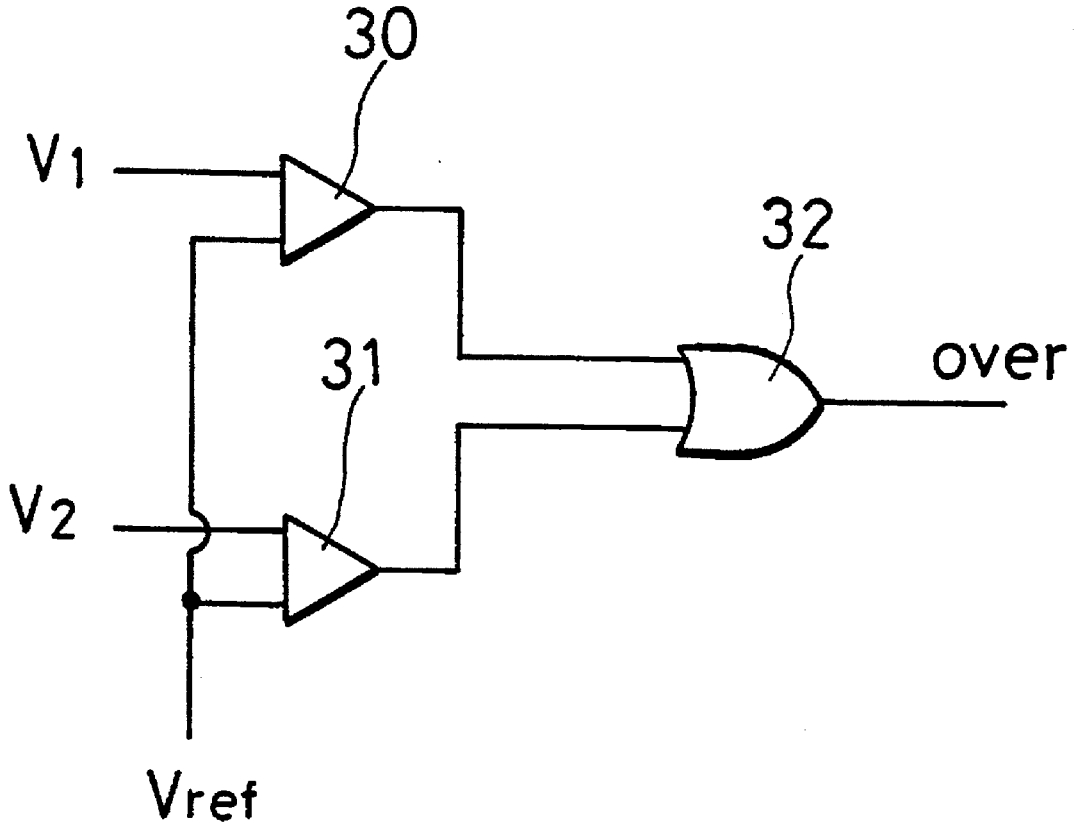

In this arrangement, in order to judge whether or not the outputs of the distance-measuring sensor 5 are within the predetermined range, the outputs of the distance-measuring sensor 5 are compared with the predetermined values. However, the present invention is not intended to be limited to this arrangement; another arrangement may be adopted as explained hereinbelow: For example, as shown in FIG. 9, the outputs from the distance-measuring sensor 5 are converted into voltages V1 and V2 corresponding to the output currents I1 and I2, and the resulting output values are compared with reference voltages Vref respectively corresponding to the maximum and minimum values in comparators 30 and 31. If those values respectively exceed and go below the reference voltages Vref, the resulting signals released from the comparators 30 and 31 are supplied to the CPU 20 as Over signals through an 0R gate 32. When the CPU 20 receives those signals, a decision is unconditionally made that no original document is present. In this case, if the process of n5 is carried out without inputting data from the signal processing circuit 25, wasteful processes can be omitted. Here, the comparators 30 and 31 and the OR gate 32 are installed in the signal processing circuit 25.

After detecting the presence or absence of original document as described above, the CPU 20 provides appropriate control of copying operation based on the process of n5 or n8. In other words, if the presence of an original document is detected, the control of copying operation is provided in response to the operation of the copy start switch; while, if the absence of original document is detected, the start of copying operation is interrupted regardless of the operation of the copy start switch.

Moreover, in the case of detecting the size of the placed original document simultaneously with the detection as to the presence or absence of original document, the distance-measuring sensors 5A through 5D, which are disposed as shown in FIG. 3, carry out their detections as to the presence or absence of original document respectively in accordance with the flow chart of FIG. 7. The CPU 20 discriminates the size of the original document based on the results of these detections in a manner as shown in Table 1.

In accordance with the size of the original document, the CPU 20 provides control of copying operation such that a size of copy sheets suitable for the detected document size is selected, or a size of copy sheets to be used is automatically selected in accordance with the selected magnification, and the selected copy sheets are supplied. Further, if the size of copy sheets to be used has already been selected, the CPU 20 automatically sets the copy magnification in accordance with the detected document size, and carries out a copying operation suitable for the set magnification.

The following description will discuss a sequence of control operations wherein fault detection is accomplished by the distance-measuring sensor 5 itself, that is, by a self-diagnosis thereof, and the detection as to the presence or absence of original document on the document platen 2 is effectively made by using the distance-measuring sensor 5 that always provides an accurate distance measurement. This arrangement provides an accurate detection of the document size, thereby ensuring appropriate copy control. As the result of the self-diagnosis, in the case where any failure is detected in the distance-measuring sensor 5 and the failure is not related to the copying apparatus itself, even if the detection of original document is automatically carried out, a normal copying operation is available if the control is not carried out based on the resulting detection. FIG. 8 shows the control flow chart, wherein copy control is provided by means of manual operations upon receipt of the detection of the failure.

The control flow chart of FIG. 8 shows a sequence of control operations that are executed after the processes (at n5 or n8) related to the presence or absence of original document that are shown in the control flow chart of FIG. 7.

In this arrangement, after executing the distance-measuring operation related to the detection of original document in the course of closing the document cover 4, when the document cover 4 is closed to press the original document placed on the document platen 2, this closed state is detected by a detection switch 7. This detection switch 7, installed separately from the detection switch 6, is a microswitch which turns on when the document cover 4 has been completely closed and is disposed at a position suitable for the detection of the closed state of the document cover 4 (see FIG. 1).

After the detection switch 7 has detected the closed state of the document cover 4 (n10), the distance-measuring sensor 5 starts making the distance measurement, and the voltages V1 and V2 derived from the currents I1 and I2 of the distance-measuring sensor 5 are inputted to the CPU 20, and stored therein (n11).

Then, the distance L is measured based on the stored data, that is, the distance L is calculated based on V1 and V2 (n12). The measured distance L is compared with a reference distance LO (n13). The reference distance LO is a distance up to the document-bearing surface of the document platen, and if the measurement is made with the document cover 4 completely closed, the distance-measuring sensor 5 is supposed to measure the distance up to the document-bearing surface. This distance is constant regardless of the presence of the original document 3. Therefore, in comparison with the reference distance LO preliminarily stored, if the measured distance L is equivalent thereto, a decision is made that the distance-measurement made by the distance-measuring sensor 5 is normal, thereby deciding that the document detection described in FIG. 7 is effective. Thus, copy control is operated based on the resulting detection related to the presence or absence of original document as well as the document size (n14).

Here, as to the reference distance LO, taking into consideration errors in the measurement, warp of the document cover 4, or other factors, a margin width $\alpha$ is set and an effective range is set by using the upper and lower limits of the margin width $\alpha$. More specifically, if the measured distance L is located within the range, $LO-\alpha \leqq L \leqq LO+\alpha$, it is confirmed that the distance measurement is properly carried out by the distance-measuring sensor 5.

In contrast, in a state where no distance measurement is available with the measured distance L located out of the range of LO, a display indicating malfunction is provided. Thus, upon executing the process (n5) related to the absence of original document at n3 or n4 in FIG. 7, if any failure is detected as the result of the self-diagnosis for confirming whether or not the sensor is normal, the process related to the absence of original document is nullified based on the results of the self-diagnosis even after having executed the process related to the absence of original document. In other words, this arrangement is very effective since any failure in detection due to external light or other reasons is prevented even if the process related to the absence of original document is executed in an abnormal state of the distance-measuring sensor 5.

When any failure is detected as the result of the self-diagnosis at n 13, the display indicating the malfunction of the document detection device is provided at n15. Then, a timer T is set (n16) so that the copying operation is inhibited (n17) until the timer T has counted up to a predetermined period of time (n1, n19), and after the lapse of the predetermined period of time (n18), the copying operation is allowed to start (n20). The control of the copying operation is provided not based on the document detection made by the document detection device, but by means of manual operation. In other words, the copying operation is started in response to the operation of the copy start switch irrespective of the existence of original document on the document platen. Further, in accordance with the start of the copying operation, copy sheets, the size of which has been manually selected, are supplied, and the copying operation is controlled in accordance with the copy magnification that has been manually selected. In short, the manual operation mode is turned on.

Here, the copying operation is inhibited for the predetermined period of time (A) set in the timer T in order to inform the user that automatic copy control associated with the document detection device is not available, and that only the copy control by means of manual operation is available.

As described above, the self-diagnosis is carried out on the distance-measuring sensor 5 itself by detecting the completely closed state of the document cover 4 by the use of the detection switch 7, and if any failure is detected as the result of the self-diagnosis, the manual operation mode is turned on without providing the automatic selection control based on the document size detection, and the copying operation is carried out by the manual operation. This arrangement makes it possible to eliminate erroneous copying operations. Further, this state of failure is stored in a failure-memory. This storage is made in the RAM 22 or other devices, and the contents of the memory are kept from being lost by providing a separate power source or other devices to back up the memory even when the power of the copying apparatus main body is shut off. Therefore, this arrangement is used for making a selection between the automatic mode that carries out the copy control based on the document detection and the manual copy mode associated with the manual operation, after the contents of the failure-memory are discriminated upon turning on the power source. Thus, the CPU itself makes a decision as to whether the automatic mode or the manual mode should be turned on when the power source of the copying apparatus is turned on, and allows the resulting state to be displayed, thereby preventing erroneous copying operations beforehand. The failure-memory is cleared by a manual operation after the state of failure has been corrected, that is, after the normal state has been restored by replacing the distance-measuring sensor or other devices.

As described above, the document detection device of the present invention discriminates the presence or absence of original document by using a measured distance obtained by the distance-measuring sensor; this makes it possible to clearly distinguish an original document from the document cover and to provide an accurate document detection as well as providing an accurate document-size detection.

Moreover, if the output of the distance-measuring sensor is located within a predetermined range, a discrimination is made as to the presence or absence of original document based on the distance measurements, and if it is not located within the predetermined range, the process related to the absence of original document is carried out. Therefore, an accurate detection is made as to the presence or absence of original document without being affected by external light or other factors, and by adopting the document detection device in a copying apparatus, it becomes possible to eliminate the necessity of considerations that are given to the installation site or other factors of the copying apparatus.

Furthermore, a self-diagnosis is made on the distance-measuring sensor itself based on the detection as to the presence or absence of original document, and depending on the result of the self-diagnosis, a decision is made as to whether the detection as to the presence or absence of original document is effective, or is to be nullified. Since only the manual operation is allowed when the document detection is nullified, it is possible to prevent erroneous copying operations as well as providing high-quality copy control suitable for the original document 3 in question.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A document detection device for detecting whether or not an original document is placed on a document platen, comprising:

first detection means for detecting a state where a document cover, which is attached to the document platen so as to be freely opened and closed, is inclined at a predetermined angle with the document platen, and for releasing a measurement-start signal;

measuring means for measuring a distance up to the original document on the document platen or up to the document cover;

control means for controlling the measuring means so as to allow it to start the distance-measuring operation upon receipt of the measurement-start signal; and document-existence discrimination means for receiving the distance measured by the measuring means and for detecting the presence or absence of original document by making a judgement that an original document has been placed when the measured distance is within a predetermined range as well as making a judgement that no original document has been placed when the measured distance is out of the predetermined range.

2. The document detection device as defined in claim 1, wherein the measuring means includes light-emitting means for projecting light to the document platen and light-receiving means for receiving the projected light, the light-emitting means and the light-receiving means being respectively installed below the document platen.

3. The document detection device as defined in claim 1, wherein the measuring means, which includes a plurality of light-emitting means for projecting light to the document platen and the same number of light-receiving means for receiving the projected light, the light-emitting means and the light-receiving means being respectively installed below the document platen in relation to various sizes of copy sheets, allows the light-emitting means to project light in response to the measurement- start signal, and wherein the document-existence discrimination means identifies the size of the original document placed on the document platen in accordance with outputs of those light-receiving means.

4. The document detection device as defined in claim 1, wherein the measuring means includes a PSD (Position Sensitive Detector).

5. The document detection device as defined in claim 1, wherein the first detection means is a mechanical detection switch that is installed in the proximity of an axis portion for allowing the document cover to be freely opened and closed.

6. The document detection device as defined in claim 3, wherein the control means allows the light-emitting means to start projecting light in a time-divided manner upon receipt of the measurement-start signal.

7. The document detection device as defined in claim 1, wherein supposing that $\alpha$ is a predetermined margin width that is determined by taking into consideration errors in measurement, warp of the document cover, or other factors, LO is a reference distance that is a distance up to the document platen, and L is a measured distance, the document-existence discrimination means, upon receipt of the measured distance, makes a judgement that an original document is present if LO satisfies an inequality, $LO \leqq L \leqq (LO+\alpha)$, as well as making a judgement that no original document is present if LO does not satisfy the inequality.

8. A copying apparatus for controlling copying operations in accordance with a detection as to the presence or absence of original document, comprising:

first detection means for detecting a state where a document cover, which is attached to a document platen so as to be freely opened and closed, is inclined at a predetermined angle with the document platen, and for releasing a measurement-start signal;

measuring means for measuring a distance up to the original document on the document platen or up to the document cover;

control means for controlling the measuring means so as to allow it to start the distance-measuring operation upon receipt of the measurement-start signal;

document-existence discrimination means for receiving the distance measured by the measuring means and for detecting the presence or absence of original document by making a judgement that an original document has been placed when the measured distance is within a predetermined range as well as making a judgement that no original document has been placed when the measured distance is out of the predetermined range; and copy control means for carrying out a copying operation in the presence of original document, and for inhibiting the copying operation in the absence of original document, in response to the document-existence discrimination means.

9. The copying apparatus as defined in claim 8, wherein the measuring means includes light-emitting means for projecting light to the document platen and light-receiving means for receiving the projected light, the light-emitting means and the light-receiving means being respectively installed below the document platen.

10. The copying apparatus as defined in claim 8, wherein the measuring means, which includes a plurality of light-emitting means for projecting light toward the document platen and the same number of light-receiving means for receiving the projected light, the light-emitting means and the light-receiving means being respectively installed below the document platen in relation to various sizes of copy sheets, allows the light-emitting means to project light in response to the measurement- start signal, and wherein the document-existence discrimination means identifies the size of the original document placed on the document platen in accordance with outputs of those light-receiving means.

11. The copying apparatus as defined in claim 8, wherein supposing that $\alpha$ is a predetermined margin width that is determined by taking into consideration errors in measurement, warp of the document cover, or other factors, LO is a reference distance that is a distance up to the document platen, and L is a measured distance, the document-existence discrimination means, upon receipt of the measured distance, makes a judgement that an original document is present if LO satisfies an inequality, $LO \leqq L \leqq (LO+\alpha)$, as well as making a judgement that no original document is present if LO does not satisfy the inequality.

12. The copying apparatus as defined in claim 8, further comprising:

second detection means for detecting a state where the document cover has been completely closed and releasing a second measurement-start signal;

comparison means for comparing a distance measured by the measuring means in accordance with the second measurement-start signal with a reference distance;

decision means for making a decision that the measuring means is normally operable when the measured distance is within a predetermined range, and for making a decision that the measuring means is inoperable when the measured distance is out of the predetermined range, as the result of the comparison; and copy control means for carrying out copying control based on the output of the document-existence discrimination means in the case of the decision that the measuring means is normally operable, and for manually carrying out copying control irrespective of the output of the document-existence discrimination means in the case of the decision that the measuring means is inoperable.

13. The copying apparatus as defined in claim 12, further comprising:

display means for displaying a "failure message" in the case where the decision means decides that the measuring means is inoperable; and timer means for counting up to a predetermined period of time where the decision means decides that the measuring means is inoperable, wherein the copy control means inhibits a copying operation during the predetermined period of time counting.

14. The copying apparatus as defined in claim 12, wherein supposing that $\alpha$ is a predetermined margin width that is determined by taking into consideration errors in measurement, warp of the document cover, or other factors, LO is a reference distance that is a distance up to the document platen, and L is a measured distance, the decision means, upon receipt of the measured distance, makes a judgement that the measuring means is normally operated if LO satisfies an inequality, $(LO-\alpha \leqq L \leqq (LO+\alpha)$, as well as making a judgement that the measuring means is inoperable if LO does not satisfy the inequality.

15. The document detection device as defined in claim 2, wherein the light-receiving means releases two detection currents whose intensities vary in correlation with each other depending on a light-receipt position of the projected light and the measuring means has conversion means for converting the detection currents into respective voltages.

16. The document detection device as defined in claim 15, wherein the measuring means includes comparison means for comparing the measured distance with a reference distance.

17. The document detection device as defined in claim 16, wherein the comparison means comprises:

a first comparator and a second comparator which compare the two voltages released from the conversion means with respective reference voltages, the reference voltages being related to a maximum value and a minimum value of a voltage that is supposed to be released when the projected light from the light-emitting means is reflected from the original document or the document cover and received by the light-receiving means, and either of which releases an abnormal signal when either of the two voltages exceeds the higher reference voltage, or goes below the lower reference voltage; and an OR gate for carrying out the logical OR between outputs from the first and second comparators, and wherein the document-existence discrimination means makes a decision that no original document is present unconditionally upon receiving the abnormal signal from the OR gate.

18. The copying apparatus as defined in claim 8, wherein the light-receiving means releases two detection currents whose intensities vary in correlation with each other depending on a light-receipt position of the projected light and the measuring means has conversion means for converting the detection currents into respective voltages.

19. The copying apparatus as defined in claim 18, wherein the measuring means includes comparison means for comparing the measured distance with a reference distance.

20. The copying apparatus as defined in claim 16, wherein the comparison means comprises:

a first comparator and a second comparator which compare the two voltages released from the conversion means with respective reference voltages, the reference voltages being related to a maximum value and a minimum value of a voltage that is supposed to be released when the projected light from the light-emitting means is reflected from the original document or the document cover and received by the light-receiving means, and either of which releases an abnormal signal when either of the two voltages exceeds the higher reference voltage, or goes below the lower reference voltage; and an OR gate for carrying out the logical OR between outputs from the first and second comparators, and wherein the document-existence discrimination means makes a decision that no original document is present unconditionally upon receiving the abnormal signal from the OR gate.

* * * * *